US005492654A

United States Patent [19]

Kozjuk et al.

[11] Patent Number: 5,492,654

[45] Date of Patent: Feb. 20, 1996

[54] METHOD OF OBTAINING FREE DISPERSE SYSTEM AND DEVICE FOR EFFECTING SAME

[75] Inventors: Oleg V. Kozjuk, ul. Strazhesko, d.I, kv. 24, 252I26, Kiev; Alexandr A. Litvinenko, ul. Sholom-Aleikhema, d. 8a, kv. 48, 252I40, Kiev; Boris K. Kravets; Viktor V. Berezin, both of Kiev, all of Ukraine

[73] Assignees: Oleg V. Kozjuk; Alexandr A. Litvinenko, both of Kiev, U.S.S.R.

[21] Appl. No.: 284,922

[22] Filed: Aug. 2, 1994

Related U.S. Application Data

[63] Continuation of Ser. No. 94,159, Jul. 26, 1993, abandoned which is the U.S. national stage of International Application PCT/SU91/00251, filed on Nov. 29, 1991.

[51] Int. Cl.[6] ..... B01F 3/04

[52] U.S. Cl. ..... 261/76; 366/336

[58] Field of Search ..... 366/366, 367, 366/368; 261/76

[56] References Cited

U.S. PATENT DOCUMENTS

| | | | |
|---|---|---|---|
| 3,467,072 | 9/1969 | Toesca | 261/76 |
| 3,834,982 | 9/1974 | Alexandrovich et al. . | |
| 3,937,445 | 2/1976 | Agosta . | |
| 3,942,765 | 3/1976 | Henrickson | 366/336 |
| 4,164,375 | 8/1979 | Allen | 366/337 |
| 4,316,673 | 2/1982 | Speer | 366/337 |
| 4,344,752 | 8/1982 | Gallagher, Jr. | 366/336 |
| 4,464,057 | 8/1984 | Darrieu et al. | 366/337 |
| 4,498,786 | 2/1985 | Ruscheweyh | 366/336 |
| 4,506,991 | 3/1985 | Hudson . | |
| 4,674,888 | 6/1987 | Carlson | 366/337 |
| 4,929,088 | 5/1990 | Smith | 366/336 |
| 5,145,256 | 9/1992 | Wiemers et al. | 366/337 |

FOREIGN PATENT DOCUMENTS

| | | | |
|---|---|---|---|
| 2035008 | 3/1970 | France . | |
| 2385438 | 3/1977 | France . | |
| 45-40634 | 12/1970 | Japan | 366/338 |
| 1066630 | 1/1984 | U.S.S.R. . | |
| 1311769 | 5/1987 | U.S.S.R. | 366/336 |
| 745050 | 8/1988 | U.S.S.R. . | |

*Primary Examiner*—Tim R. Miles
*Attorney, Agent, or Firm*—Collard & Roe

[57] ABSTRACT

A method of obtaining a free disperse system and a device for producing the cavitation effect is provided in which the passage of a hydrodynamic flow through a channel internally accommodating a baffle body providing a local contraction of the flow in at least two sections and forming a cavitation field downstream of the body. The ratio of velocity of the flow at each of the sections to the velocity of a free disperse system at the outlet of the channel is maintained equal to 2.1 and the degree of cavitation is maintained at a level equal to at least 0.5. A cavitation device comprises the baffle body including at least two elements providing generation of their own cavitation fields different in the degree of cavitation. The degree of cavitation is determined by the ratio of a characteristic length of the cavitation field to the size of a baffle body in the cross-section thereof in the place of a local contraction, is determined by the size and shape of the baffle body, the size of the chamber containing the baffle body, the pressure range induced, and the flow rate of the fluid. The invention may preferably be used for preparation of emulsions.

17 Claims, 3 Drawing Sheets

METHOD OF OBTAINING FREE DISPERSE SYSTEM AND DEVICE FOR EFFECTING SAME

This is a continuation of application Ser. No. 08/094,159 filed on Jul. 26, 1993, now abandoned, which is the U.S. national stage of International Application PCT/SU91/00251 filed on Nov. 29, 1991.

BACKGROUND OF THE INVENTION

1. Field of the Invention

The present invention relates to a method of obtaining a free disperse system and device which will make it possible to produce a controlled hydrodynamic cavitation and to regulate the intensity parameters of a hydrodynamic cavitation field. Selection of the parameters with regard to the properties of components of the fluid under treatment which in turn will make it possible to effectively treat the components with different physico-chemical characteristics. The invention particularly relates to a cavitation device for effecting this method with a baffle body of such a construction which will allow the multiplicity of treatment to be regulated along with an increase in degree of cavitation which will substantially improve the quality of an obtained free disperse system and will substantially extend technological capabilities of the method.

2. The Prior Art

Widely known in the prior art are methods of obtaining free disperse systems and particularly lyosols, diluted suspensions and emulsions, using the effect of cavitation. These systems are fluidic and particles of a dispersed phase have no contacts, participate in a random beat motion and freely move by gravity. In these methods, the emulsification and dispersion processes are accomplished due to cavitation effects expediently set up in the flow under treatment by hydrodynamic means at the expense of a sharp change in geometry of the flow.

Also known in the prior art are devices for effecting these methods of which the basic element is presented by a baffle body installed in a flow channel in the direction of a hydrodynamic flow.

Phenomenon of the hydrodynamic cavitation resides in the formation of cavities filled with a vapor-gas mixture inside the liquid flow or at the boundary of the baffle body due to a local pressure drop caused by movement of the fluid. Mixing, emulsification and dispersion effects of the hydrodynamic cavitation result from a substantial plurality of force effects on the treated mixture of components due to the collapse of cavitation bubbles. The collapse of cavitation bubbles near the boundary of "liquid-solid particles" phases results in dispersion of these particles in the fluid and in formation of the suspension, while in the "liquid-liquid" system one fluid is atomized in the other fluid and results in formation of the emulsion. In both cases, the boundary of solid phases is destroyed, i.e. eroded and a dispersive medium and a dispersed phase are formed.

For the most part, the models explaining the mechanism of emulsification and dispersion processes accomplished by means of cavitation are based at the present time on the use of a cumulative hypothesis of the cavitation effect on a surface to be destroyed. The process of dispersion by means of cavitation is associated with the formation of cumulative microjets. It is supposed, that due to the interaction of a shock wave set up by the collapse of cavitation bubbles with the bubbles arranged at the boundary of the phases, the cumulative microjets are formed. Intensive mixing and dispersion is explained by the formation of high-intensity microvortices and by a sequential disintegration of the cumulative microjets. The process of the fluid atomization is caused by tangential stresses acting on the referred fluid and occurring at the boundaries of cavitation microvortices, while the dispersion of solid particles is accomplished due to a hydrodynamic penetration of a cumulative microjet into a particle.

In addition to erosion effects caused by the collapse of cavitation bubbles, other physico-chemical effects occur serving as additional factors in the intensification of technological processes.

It should also be noted that physical characteristics of the mixture of components in the flow under treatment have a substantial influence on the erosion activity of cavitation bubbles. For example, increase of viscosity, decrease of surface tension and density of the fluid, as well as increase of the gas content therein reduce the efficiency of the cavitation effect.

There is also known, a method of obtaining a free disperse system, i.e. a suspension of fibrous materials, involving the passage of a hydrodynamic flow of fibrous materials through a channel internally accommodating a baffle body installed across the flow for providing a local contraction of the flow and forming downstream of the referred body a hydrodynamic cavitation field acting on the flow of fibrous materials until the suspension of the referred materials is formed.

An attempt was made for effecting the method described hereinabove, in which a device was proposed consisting of a housing with inlet and outlet openings, a contractor, an internal flow channel accommodating a solid cylindrical baffle body and a diffuser (U.S. Pat. No. 3,834,982) arranged in succession on the inlet opening side and connected together.

SUMMARY OF THE INVENTION

The invention is essentially aimed at providing a method of obtaining a free disperse system which will make it possible to regulate the intensity of a hydrodynamic cavitation field and to select its parameters with due regard to properties of components of the flow under treatment. This in turn will make it possible to effectively treat the components with different physico-chemical characteristics and to develop a device for effecting this method with a baffle body of such a design which will allow the multiplicity of treatment to be regulated along with increasing the degree of cavitation which will substantially improve the quality of an obtained free disperse system and will substantially extend technological capabilities of the method.

This is attained by, that in a method of obtaining a free disperse system involving the passage of a hydrodynamic flow of components through a channel internally accommodating a baffle body providing a local contraction of the flow, a hydrodynamic cavitation field is formed downstream of this body which affects the flow of components under treatment and forms a flow of the free disperse system. According to the invention, the local contraction of the flow is accomplished at least at two sections of the flow channel, with the profile of a cross-section of each of the referred sections and the distance between them being selected on condition that the ratio of the velocity of the referred flow on each of these sections to the velocity of the flow of the free disperse system at the outlet from the flow channel is equal to at least 2.1 and the degree of cavitation of the hydrodynamic flow of the cavitation field is equal to at least 0.5.

Such a method makes it possible to obtain high-quality aggregate-stable lyosols, emulsions and suspensions from components, having different physico-chemical characteristics, at the expense of a more complete utilization of erosion activity of the field of cavitation microbubbles and energy of the flow of components under treatment.

Maintenance of the above-mentioned values of the referred parameters (ratio of velocities and degree of cavitation) is an indispensable condition for setting up and developing the hydrodynamic cavitation under the referred conditions.

With such a ratio of velocities and due to the set-up of hydrodynamic effects, shock waves are formed and intensively affect the cavitation field of bubbles which collapse and form cumulative jets. Due to this fact, conditions are set up for coordinated collapse of groups of cavitation bubbles in a local volume along with the formation of high-energy three-dimensional shock waves whose propagation intensifies the disintegration of cavities and collapse of groups of cavitation bubbles, found in the process of collapse. In the case of a coordinated collapse of cavitation bubbles having the same characteristic dimensions, the intensity and energy potential of the cavitation field is approximately one order of magnitude higher than at a single non-coordinated collapse of bubbles.

Thus, the energy is concentrated and the erosion effect is enhanced on the flow of components under treatment. Secondary shock waves formed as a result of impacts of microjets on the walls of cavitation bubbles during their interaction are also intensively affecting this flow. All of this provides conditions for initiation of vibro-turbulent effects due to which the components are intensively mixed and redistributed in the local volume of the flow channel, and subjected to additional treatment. Furthermore, the effects described hereinabove facilitate disintegration of the cavities formed downstream of the baffle body into a more homogenous field of relatively small cavitation bubbles, thereby causing a high efficiency of their coordinated collapse. Due to the increase in the number of sections with the local contraction, and the appropriate selection of the profile of cross-section and the distance between the referred sections, it has become possible to increase the number of zones with flow treatment cavitation effect and, respectively, on the multiplicity of the flow treatment.

The method, according to the invention, makes it possible to regulate the intensity of an occurring hydrodynamic cavitation field as applied to specific technological processes.

For increasing the multiplicity of treatment of the flow of components, the sections of the local contraction of the flow may expediently be formed in succession, one after another, in the direction of the flow.

To form a hydrodynamic cavitation field substantially throughout the entire cross-section of the flow channel and to reach the maximum intensity of the referred field, the sections of the local contraction of the flow may advantageously be formed in parallel with one another in one cross-section of the flow channel.

For optimizing the processes of dispersion and emulsification, it is desirable that a gaseous component be introduced in the hydrodynamic flow of components at least at one section of local contraction or directly into the referred flow.

This is attained by, that in the proposed device for obtaining a free disperse system comprising a housing with inlet and outlet openings, a contractor, a flow channel internally accommodating a baffle body and a diffuser, are sequentially arranged in the housing on the side of the inlet opening and connected with one another.

According to the invention, the baffle body comprises at least two interconnected elements, the shape of which and the distance between them are selected from the conditions of its own hydrodynamic field that is formed downstream of each element with a degree of cavitation equal to at least to 0.5 and differing by the degree of cavitation from the hydrodynamic cavitation fields of other elements and capable of interaction.

Such a design embodiment of the baffle body makes it possible to regulate the intensity of the effect exerted by the hydrodynamic cavitation fields on the components in the process of their mixing, dispersion and emulsification. This will allow the proposed method of obtaining a free disperse system to be effected in a wide range of technological capabilities along with a substantial decrease of energy consumption at the expense of a more complete utilization of the energy of the flow under treatment and with an improved quality of the free disperse system.

In order to provide a reliable regulation of the intensity of cavitation fields and hence the adjustment of the device for an optimum mode of operation, it is preferred that the baffle body be provided with three elements in the form of hollow truncated cones arranged in succession in the direction of the flow and oriented by their smaller bases toward a contractor, and each preceding cone in the direction of the flow be provided with a diameter of the larger base exceeding the diameter of the larger base of each subsequent cone, and the cones be secured on rods installed coaxially in the flow channel and coaxially with one another, and adapted for axial displacement relative to one another.

The distance between each preceding and subsequent cones may advantageously be equal to at least to 0.3 diameter of the larger base of the preceding cone and the taper angle of each subsequent cone may be smaller or essentially equal to the taper angle of each preceding cone.

With such a relative arrangement of the baffle body elements in the flow channel, their own hydrodynamic cavitation field is formed downstream of each of the said elements and these fields have a different degree of cavitation, but at least 0.5, determined by the geometry of these elements and the length of a generated field. In the process of mixing, dispersion and emulsification, the degree of cavitation of these fields is easy to regulate by displacement of each subsequent element in the direction of the flow. Relative displacement of the elements makes it possible to change the position of sections with a local contraction of the hydrodynamic flow throughout the length of the flow channel and hence the position of the cavitation fields occurring downstream of the elements and the intensity of their interaction. This makes it possible to regulate the degree of cavitation and the multiplicity of treatment of the flow with components.

The elements of a baffle body may preferably be made in a hemispherical shape. The elements made in the form of revolving bodies allows it to easily obtain different forms of cavitation, for example, vortex cavitation or supercavitation, depending on a required intensity of a hydrodynamic cavitation field. The sections of local contraction throughout the flow channel have an annular profile which is optimum when using the energy of a hydrodynamic flow for treatment of components.

For reducing the consumption of energy by making the most use of the kinetic energy of a hydrodynamic flow, the baffle body may be suitably provided with three elements each made in the shape of a truncated cone with different taper angles and arranged so that their axes are in the plane of one cross-section of a flow channel and associated by smaller bases with a holder installed in the flow channel coaxially, and by larger bases contacting the wall of a flow channel, and the angles between axes of truncated cones are selected on condition of providing equal gap areas between the said cones.

For regulating the degree of cavitation of the cavitation fields occurring downstream of the truncated cones, the end cones may advantageously be associated with a holder for turning about the axes arranged in the plane perpendicular to the axis of the flow channel.

When the gap areas are equal, the flow of treated components is uniformly distributed in the flow channel, thereby providing the same hydrodynamic conditions for the elements forming their own hydrodynamic cavitation field downstream. Embodiment of these elements in the shape of truncated cones with different taper angles defines the difference of their diameters in the cross-section along the arc and allows the elements to generate the cavitation fields of different intensity. Formed downstream of each of the elements are non-stationary moving cavities, different in structure and magnitude, which in the increased pressure zone form cavitation bubbles of different characteristic dimensions defining the structure of generated cavitation fields. These cavitation fields interact with one another, thereby providing an intensive mixing of the bubbles and saturation of the flow of treated components with the referred bubbles throughout the entire volume of the flow channel. Due to the poly-dispersive structure of a conunon cavitation field formed from single cavitation fields, a concentration mass of cavitation bubbles is increased in the bubble collapse zone, thereby enhancing the effectiveness of the cavitation treatment. Different mean diameters of the elements also define different frequencies of separation of cavities formed downstream of the referred elements. Therefore, in the bubble collapse zone, the cavitation bubbles are acted upon by multiple-frequency pressure pulsations which determine the conditions for a coordinated collapse of groups of cavitation bubbles of the same dimensions. As a result, formed shock waves increase the pressure in the bubble collapse zone and a wide spectrum of multiple-frequency pressure pulsations have an effect not only on the collapsing cavitation bubbles but also on the cavities moving in the flow, thereby facilitating their disintegration and intensifying the process of mixing, dispersion and emulsification of components under treatment.

For intensifying the cavitation effect on the flow of treated components, the device may be suitably provided with at least one additional baffle body similar to the main one and installed downstream of it in the direction of the flow and connected by means of a flexible element for displacement along the axis of the flow channel.

Due to the presence of a flexible element, the second baffle body under the action of an impingement flow under treatment performs longitudinal and radial auto-resonant oscillations, thereby causing pulsations on the flow and intensive disintegration of the boundary layer on the surface of elements of the baffle bodies downstream which formed their own cavitation fields. An impulse dilatation passes through these cavitation fields and provides the formation of cavitation bubbles having sufficiently large initial dimensions and therefore possessing high potential energy. Subsequent passage of a high pressure impulse through these cavitation fields results in their more "severe" collapse. Additionally accumulated potential energy makes it possible to obtain a larger interphase of components of the flow undertreatment. In addition, the pulsations of cavitation fields, caused by the second baffle body and its flexible element, contribute to the initiation of cavitation bubbles throughout the entire section of the flow channel which enhances the erosion effect of these fields on the flow of components under treatment.

For intensification of the hydrodynamic cavitation effect on the flow of components under treatment, the elements of a baffle body may advantageously be constructed of a resilient nonmetallic material or provided with a coating made of a resilient nonmetallic material, for example, rubber. The process of intensification is caused by a high energy potential of occurring cavitation fields additionally augmented by vibration of the nonmetallic material and also by deflection of shock waves.

BRIEF DESCRIPTION OF THE DRAWINGS

Other objects and features of the present invention will become apparent from the following detailed description considered in connection with the accompanying drawing which discloses two embodiments of the present invention. It should be understood, however, that the drawing is designed for the purpose of illustration only and not as a definition of the limits of the invention.

In the drawing, wherein similar reference characters denote similar elements throughout the several views:

Figure 1:
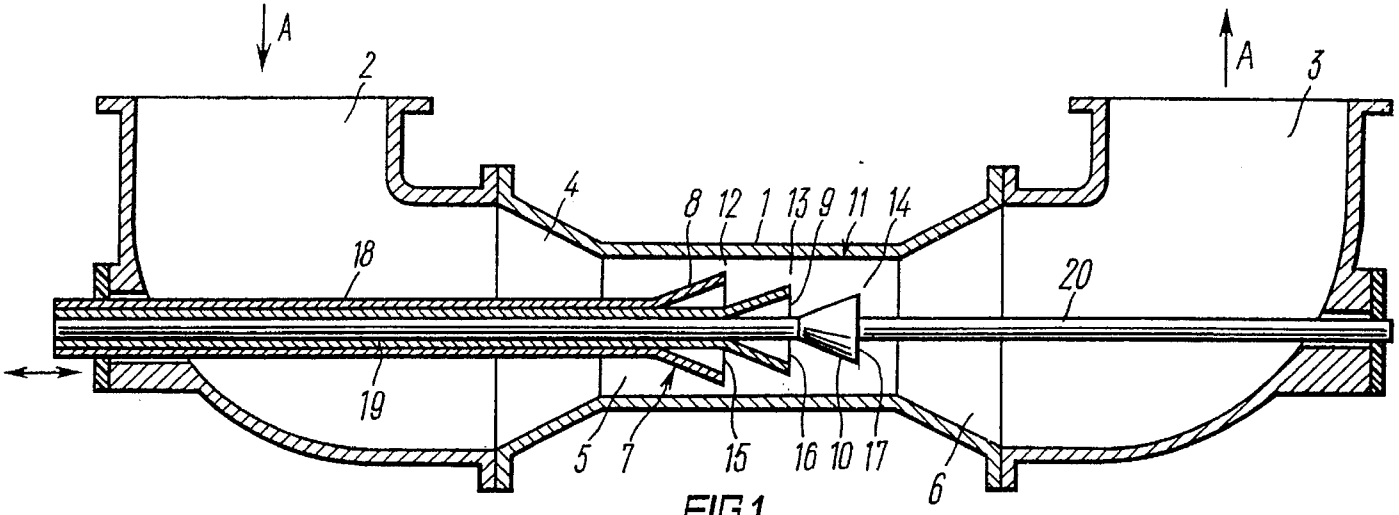
Figure 2:
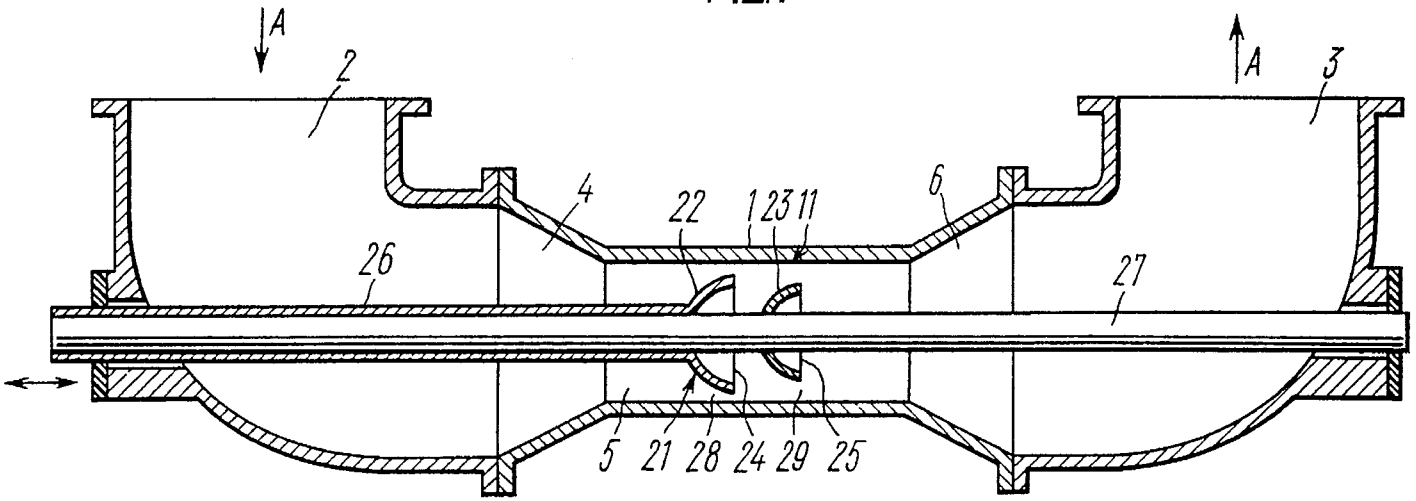
Figure 3:
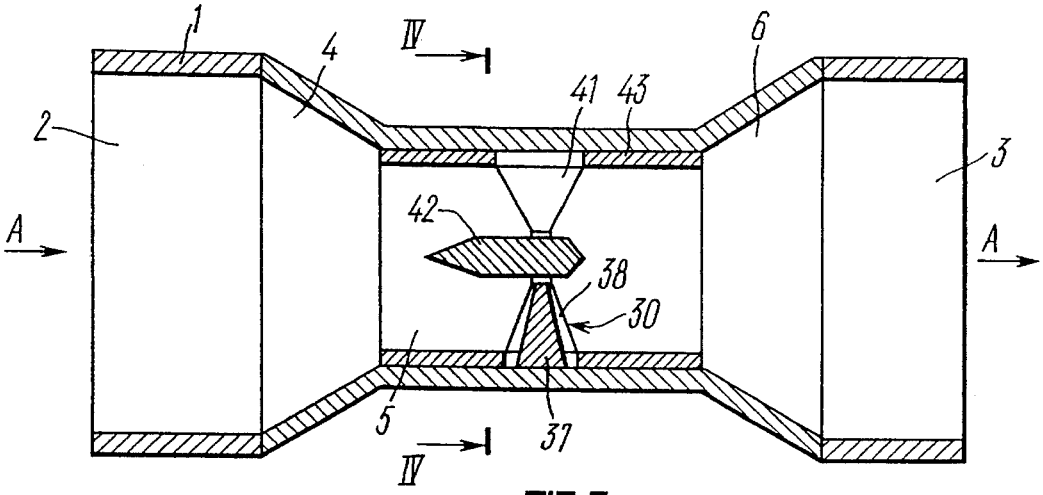
Figure 4:
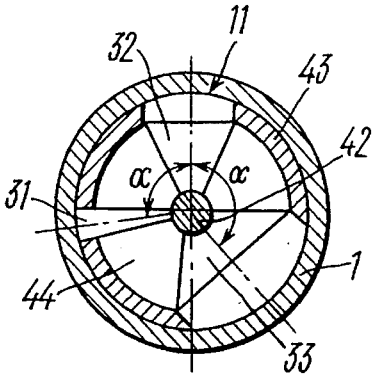
Figure 5:
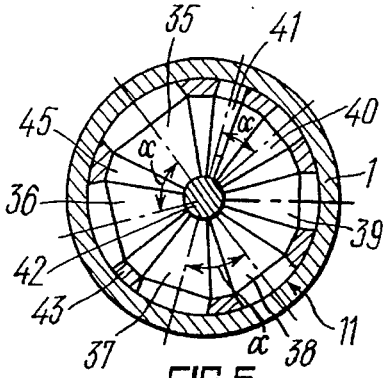
Figure 6:
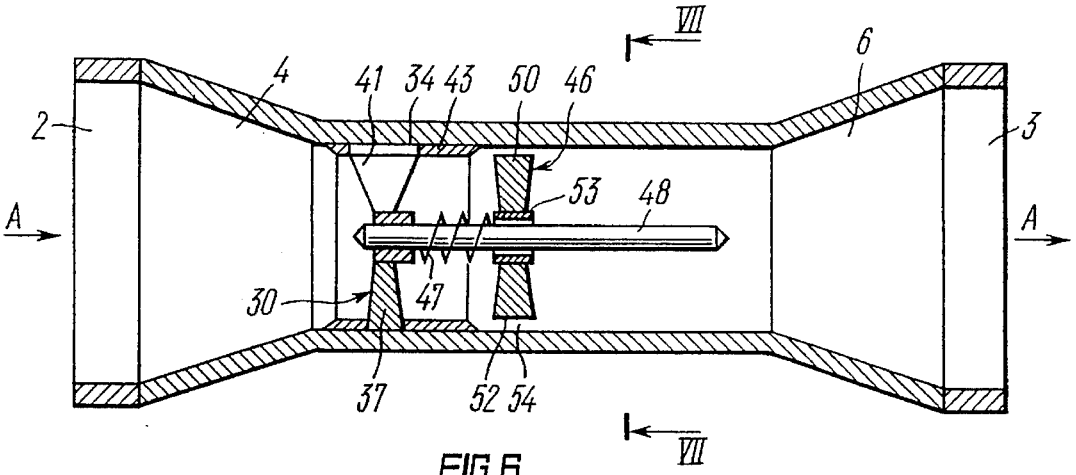
Figure 7:
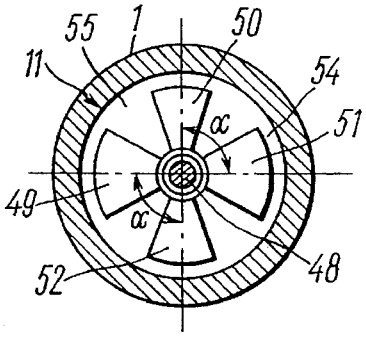

The invention will now be described in greater detail with reference to specific embodiments thereof, taken in conjunction with the accompanying drawings, according to the invention:

FIG. 1 is a diagrammatical view taken of a longitudinal section of a device for obtaining a free disperse system with a baffle body comprised of three elements in the shape of truncated cones arranged in succession;

FIG. 2 is a view like FIG. 1, showing two elements in the shape of hollow hemispheres;

FIG. 3 is a longitudinal section showing an alternative embodiment of a device for obtaining a free disperse system with a baffle body of cones arranged in one cross-section;

FIG. 4 is a cross-section taken on the line IV—IV of FIG. 3, showing a baffle body containing three elements;

FIG. 5 is a cross-section similar to FIG. 1, showing a baffle body containing seven elements;

FIG. 6 is a longitudinal section showing an alternative embodiment of a proposed device shown with main and additional baffle bodies;

FIG. 7 is a cross-section taken on the line VII—VII of FIG. 6.

BEST MODE FOR CARRYING OUT THE INVENTION

A method, according to the invention, involves the passing of a hydrodynamic flow of components under treatment, for example, water and oil components, through a flow channel internally accommodating a baffle body, for example, in the form of a body of revolution. This body has such a shape and is arranged so that the flow is subjected to a local contraction in at least at two sections of the flow channel. Formed downstream of the baffle body is a hydrodynamic cavitation field which has a mixing, dispersing and emulsifying effect on the components under treatment. For making the best use of energy of the hydrodynamic flow and providing maximum intensity of the cavitation field, the profile of the cross-section of the local contraction sections and the distance between the latter are selected on the basis that the ratio of velocity of the referred flow at each of these sections to the velocity of the flow of a free disperse system at the outlet of the flow channel is equal to least to 2.1 and the degree of cavitation of the hydrodynamic cavitation field is equal to at least 0.5. Only in this case and under the given conditions will a hydrodynamic cavitation effect occur. Depending on the physicochemical properties of the components to be treated and a required intensity of the cavitation effect, the sections of local contraction of the flow are formed in succession one after another in the direction of the flow or the sections of local contraction of the flow are formed in parallel to one another in one cross-section of the flow channel. For improving dispersion and emulsification of difficult-to-mix components, a gaseous component is introduced into the hydrodynamic flow in at least one section of the local contraction or directly downstream of the referred section.

For effecting the method, according to the invention, a device is proposed that is diagrammatically illustrated in FIGS. 1–7. In all of the proposed alternative embodiments of the device, according to the invention, there is a provision for a baffle body consisting of at least two elements of which their shape and distance between them are selected on the condition of their own hydrodynamic cavitation field formed downstream and each of these elements and their fields differ from each other in the degree of cavitation. The degree of cavitation of each local field equal to at least 0.5 is insured, otherwise no conditions will be provided for an efficient effect on the components under treatment.

Referring to FIG. 1, there is a diagrammatically shown view of a device consisting of a housing I having inlet opening 2 and outlet opening 3, and internally accommodating a contractor 4, a flow channel 5 and a diffuser 6 which are arranged in succession on the side of the opening 2 and are connected with one another. The channel 5 accommodates a baffle body 7 comprising three elements in the form of hollow truncated cones 8, 9, 10 arranged in succession in the direction of the flow and their smaller bases are oriented toward the contractor 4. The baffle body 7 and a wall 1 1 of the flow channel 5 form sections 12, 13, 14 of the local contraction of the flow arranged in succession in the direction of the flow and shaving the cross-section of an annular profile. The cone 8, being the first in the direction of the flow, has the diameter of a larger base 15 which exceeds the diameter of a larger base 16 of the subsequent cone 9. The diameter of the larger base 16 of the cone 9 exceeds the diameter of a larger base 17 of the subsequent cone 10. The taper angle of the cones 8, 9, 10 decreases from each preceding cone to each subsequent cone.

The cones may be made specifically with equal taper angles in an alternative embodiment of the device. The cones 8, 9, 10 are secured respectively on rods 18, 19, 20 coaxially installed in the flow channel 5. The rods 18, 19 are made hollow and are arranged coaxially with each other, and the rod 20 is accommodated in the space of the rod 19 along the axis. The rods 19 and 20 are connected with individual mechanisms (not shown in FIG. 1) for axial movement relative to each other and to the rod 18. In an alternative embodiment of the device, the rod 18 may also be provided with a mechanism for movement along the axis of the flow channel 5. Axial movement of the cones 8, 9, 10 makes it possible to change the geometry of the baffle body 7 and hence to change the profile of the cross-section of the sections 12, 13, 14 and the distance between them throughout the length of the flow channel 5 which in turn makes it possible to regulate the degree of cavitation of the hydrodynamic cavitation fields downstream of each of the cones 8, 9, 10 and the multiplicity of treating the components. For adjusting the cavitation fields, the subsequent cones 9, 10 may be advantageously partly arranged in the space of the preceding cones 8, 9, however, the minimum distance between their smaller bases should be at least equal to 0.3 of the larger diameter of the preceding cones 8, 9, respectively. If required, one of the subsequent cones 9, 10 may be completely arranged in the space of the preceding cone on condition of maintaining two working elements in the baffle body 7. The flow of components under treatment is show by the direction of arrow A.

A device illustrated in FIG. 2, according to the invention, comprises a baffle body 21 accommodated in the flow channel 5 and provided with two elements in the form of two hollow hemispheres 22, 23 arranged in succession in the direction of the flow and oriented by their vertices towards the contractor 4. The first hemisphere 22 in the direction of flow has the diameter of a larger base 24 which exceeds the diameter of a larger base 25 of the second hemisphere 23. The hemisphere 22 is secured on a hollow rod 26 installed coaxially in the flow channel 5. The hemisphere 23 is secured on a rod 27 installed in the space of the rod 26. The rod 27 is connected with a mechanism (not shown in FIG. 2) for its axial movement relative to the rod 26. The wall I I of the flow channel 5 and the baffle body 21 form two sections 28, 29 of the local contraction of the flow having the cross-section of an annular profile. By moving the hemisphere 23 relative to the hemisphere 22, the intensity of cavitation fields generated by said hemispheres may advantageously be regulated. The flow of components under treatment is shown by the direction of arrow A.

Referring to FIG. 3, shown is another alternative embodiment of the device, according to the invention, the flow channel 5 which internally accommodates a baffle body 30 comprising three elements in the form of truncated cones 31, 32, 33 with different taper angles, as is illustrated in FIG. 4, or a baffle body 34 comprising seven elements in the form of truncated cones 35, 36, 37, 38, 39, 40, 41 with different taper angles, as is illustrated in FIG. 5. The number of elements depends on physico-chemical characteristics of components under treatment and a required cavitation effect to be exerted on the referred components. The cones 31–33 and 35–41 are arranged so that their axes are in the plane of one cross-section of the flow channel 5.

The referred cones are secured by their smaller bases to a holder 42 (FIG. 3) having a cylindrical shape with conical ends for reducing the hydrodynamic resistance to the impingement flow and arranged coaxially with the flow channel 5. The cones 31–33 and 35–41 are secured by their larger bases in a sleeve 43 fixed on the internal wall 1 1 of the flow channel 5.

In an alternative embodiment of the device, the holder 42 may suitably be kinematically connected with smaller bases of the cones 31–33 or 35–41 (not shown in FIG. 2) and adapted for turning about the axes arranged in a plane perpendicular to the axis of the flow channel 5 (not shown in FIG. 3). Angles a between the axes of the truncated cones 31–33 (FIG. 4) or 35– 41 (FIG. 5) are selected on condition that the gap areas 44 or 45 are respectively equal. The gaps 44, 45 are essentially sections of the local contraction of the hydrodynamic flow of components being treated. The flow of components under treatment is shown by the direction of arrow A.

Referring to FIG. 6, there is a device shown, according to the invention, the flow channel 5 which internally accommodates an additional baffle body 46 with a flexible element, a spring 47, installed downstream of the body 34 in the direction of the flow and adapted for movement along the axis of the channel 5. Smaller bases of the truncated cones 35–41 a resecured, in the given alternative embodiment, on a rod 48 installed coaxially in the flow channel 5. The baffle body 46, illustrated in FIG. 7, comprises four elements in the form of truncated cones 49, 50, 51, 52 having different taper angles and the axes of which are arranged in one plane of the cross-section of the flow channel 5. The referred cones are secured by their smaller bases to a sleeve 53 installed on the rod 48 for axial and rotary motion, and their larger bases are arranged at a definite distance away from the wall II of the flow channel 5, thereby forming an annular section 54 of the local contraction of the flow. Angles a between the axes of the truncated cones 49–52 are selected on condition that the gap areas 55 between them are equal. The spring 47 connecting the baffle bodies 46 and 34 is installed coaxially with the rod 48. The flow of components under treatment is shown by the direction of arrow A.

In the described alternative embodiment, according to the invention, the elements of the baffle bodies 7, 21, 30, 34, 46 may preferably be constructed of a flexible nonmetallic material or provided with a coating made of flexible nonmetallic materials, for example, rubber.

A device, according to the invention (FIG. 1), operates in the following manner. A hydrodynamic flow with components under treatment passes along the arrow A through the inlet opening 2, the contractor 4 into the flow channel 5 and with a rise in pressure it runs on the baffle body 7, and more precisely, on its first element—the hollow truncated cone 8. Further, the flow with the components under treatment passes in succession through the annular sections 12, 13, 14 of the local contraction of the flow and streams over the successive elements: the cones 9, 10. When the flow streams over the cones 8, 9, 10, the edges of their larger bases 15, 16, 17 generate cavities which after separation are carried along by the flow in an increased pressure zone wherein they become disintegrated and form cavitation bubbles downstream of each of the cones which in turn form the structure of cavitation fields. These fields differ from one another by the degree of cavitation, as the cones 8, 9, 10 have different geometrical dimensions (diameters of the larger bases 15, 16, 17 and taper angles) and are arranged at different distances from one another. High local pressures of up to 1000 MPa (146,960 psi), emerging during the collapsing of the cavitation bubbles and interaction of the cavitation fields, have an intensive mixing and dispersing effect on the flow with components being treated. As it has been found, the intensive cavitation effect on the flow under these conditions is determined by maintaining the ratio of the flow velocities at each of the sections 12, 13, 14 to the velocity of the flow of a free disperse system being formed at the outlet of the flow channel 5 equal to at least to 2.1 and by maintaining the degree of cavitation of each of the fields equal to at least 0.5. The flow velocity at the section 12 is determined by the width of the latter and the initial velocity of the flow at the let of the device, while at the sections 13, 14, the flow velocity is determined by the position of the cones 9, 10 relative to the cone 8. With a decrease in the distance between the smaller bases of each preceding cone 8, 9 and each of the subsequent cone 9, 10, the flow velocity at the sections 13, 14 rises. A change in the distance causes a change in the length of a cavitation field which originates behind each of the cones. Therefore, the degree of cavitation and the ratio of velocities are regulated by changing the position of the cones 8, 9, 10 in relation to one another and throughout the length of the flow channel. The distance between the cones 8, 9, 10 is changed as a result of an axial displacement of the rods 19, 20 by means of respective mechanisms.

The velocity at sections 12, 13, 14 is maintained at a level equal to at least to 20 meters/sec. (65.6 feet/sec.) and the distance between the smaller bases of the cones 8, 9, 10 is maintained at a level equal to at least 0.3 of the larger diameter of each preceding cone 8, 9, respectively.

The relative displacement of the cones 8, 9, 10 makes it possible to also regulate the multiplicity of treatment of the flow of components, thereby providing a required number of cavitation zones effects depending on the physico-chemical properties of components, as each element of the baffle body 7 may function as an independent stage. After passing through all the sections 12, 13, 14 of the local contraction, the flow of treated components changes into the flow of a free dispersed system which is discharged from the device through the diffuser 6 and outlet opening 3. The quality of the obtained free dispersed system is determined by a specific surface of the dispersion phase and the diameter of the obtained particles which were predetermined depending on the required properties of the system to be obtained.

A device, according to the invention (FIG. 2) operates in the similar manner as that in the aforementioned. The hydrodynamic flow of components under treatment directed along the arrow A passes through the annular sections 28, 29 of the local contraction, streams over the baffle body 21, thus forming downstream of each of its elements in the form of the hollow hemispheres 22, 23, their own cavitation fields, differing in the degree of cavitation. The velocity at the section 29 and the degree of cavitation of these fields is regulated by the position of the hemisphere 23 relative to the hemisphere 22 by axially moving the rod 27 with the aid of a respective mechanism. The cavitation fields are interacting with one another and provide the conditions for a coordinated collapse of groups of cavitation bubbles due to which the erosion effect on the components under treatment is enhanced and the quality of the obtained free disperse system is improved.

A device, according to the invention (FIGS 3–5), operates in the following manner.

The hydrodynamic flow of components under treatment passes along the arrow A through the inlet opening 2 and contractor 4 into the flow channel 5 and after the rise of pressure it runs on the conical portion of the holder 42 and the baffle body 30 or 34. Then the flow passes through all the gaps 44 or 45 and streams over either three elements in the form of the truncated cones 35–41. Due to the equal areas of the gaps 44 or 45, the flow is uniformly distributed throughout the volume of the flow channel 5.

Embodiment of the cones with different taper angles determines their difference in the cross-section along the arch, that is, they have different mean diameters. The difference in mean diameters will determine the different frequency of separation of cavities formed behind each of the cones 31–33 or 35–41. In the process of separation, motion in the hydrodynamic flow and disintegration in the high pressure zone, cavities form downstream of each of the elements' pulsating cavitation fields comprising cavitation bubbles of different dimensions. In the process of interaction of the cavitation fields the bubbles collapse, the mass concentration of bubbles in the collapse zone increases and the cavitation treatment effect is enhanced. An essential effect on the intensification of a cavitation field has a sufficiently wide spectrum of the multiple-frequency pressure pulsations caused by a different frequency at which moving cavities separate from the cones 31–33 of 35–41. Pressure pulsations, acting not only on the collapse of bubbles but also on the disintegration of cavities, increase the energy potential of the cavitation field and make it possible to most efficiently utilize the energy of the flow with components under treatment. The initial velocity of the hydrodynamic flow will be determined on condition that the ratio of the velocity at sections of the local contraction of the flow, that is, in the gaps 44 or 45, to the velocity of the flow of a formed free disperse system at the outlet from the flow channel 5 will be maintained at a level equal to at least 2.1 in magnitude. The velocity at the sections of local contraction of the flow is set at a level equal to at least 20 meter/sec. (65.6 feet/sec.) and the degree of cavitation of each of the cavitation fields should not exceed 0.5 due to an appropriate selection of geometric parameters of the cones 31–33, 35–41 and the distance between them. The intensity of the cavitation effect on the components under treatment is regulated by changing the number of elements of the baffle body. The flow of the obtained free disperse system passes from the flow channel 5 into the diffuser 6 and is discharged from the device through the outlet opening 3.

In a device, according to the invention (FIGS. 6, 7), the hydrodynamic flow of components under treatment passes along the arrow A through the inlet opening 2. Further, the flow passes through the contractor 4 into the flow channel 5 and runs on the baffle body 34 comprising seven elements—the truncated cones 35–41. Passing through the gaps 45, the flow provides conditions when each of the cones 35–41 generates non-stationary moving cavities different in structure and magnitude. The cavities disintegrate in the high pressure zone and downstream of each of the elements form cavitation fields with a different degree of cavitation. Interaction of these fields causes an intensive mixing of cavitation bubbles and the flow is saturated with these bubbles throughout the entire volume of the flow channel 5. The cavitation effect on the components under treatment is enhanced in the zone wherein the bubbles collapse. Further, the flow runs on the second baffle body 46 and when the flow passes through gaps 55 and an annular section 54, the truncated cones 49–52 also generate cavities which are different in structure and magnitude. Under the action of an impingement flow of components under treatment and due to a degree of freedom provided by the sleeve 53, the baffle body 46 performs longitudinal and rotary resonance oscillations. These oscillations generate a dilatation impulse which passes through the cavitation fields formed downstream of the cones 49–52 and cause formation of large-size cavitation bubbles with high-potential energy. During interaction of the cavitation fields, this energy makes it possible to obtain a substantial interphase surface in a free disperse system. The spring 47 is also essentially a source of additional flow pulsations having an effect on the character of collapse of the cavitation bubbles and enhancing the erosion effect. The multiplicity of treatment of the components is increased by several times when compared with an alternative embodiment in which only one baffle body is used in the flow channel 5. The proposed embodiment of the device is most suitable for obtaining a high-quality free disperse system of a suspension type.

The flow of the created free disperse is discharged from the device through the diffuser 6 and the outlet opening 3.

The method will now be described with reference to specific embodiments examples, taken in conjunction with the prototypes, according to the invention, illustrated in FIGS. 1, 3, 5.

Example 1

A hydrodynamic flow comprising 95 mass % water and 5 mass % industrial oil is delivered at a velocity of 40.5 meters/sec. (I'@2.9 feet/sec.) through the inlet opening 2 in the device, as shown in FIG. 1. The flow of components passes through the contractor 4 in the flow channel 5 and streams over the baffle body 7. The flow velocity (V,) at the sections 12, 13, 14 of the local contraction is maintained at a level equal to 39.3 meters/sec. (128.9 feet/sec.), 42.1 meters/sec. (138.1 feet/sec.), 4').2 meters/sec. (141.7 feet/sec.), respectively. The degree of cavitation of the cavitation fields formed downstream of the hollow truncated cones 8, 9, 10 is set equal to 0.65, 0.6, 0.5, respectively. The flow of components under treatment while flowing through the channel 5 and streaming over the cones 8, 9, 10, is subjected to a cavitation effect which provides a high degree of emulsification of the components. The velocity (V) of a flow of the formed emulsion at the outlet from the flow channel amounts to 18.7 meters/sec. (61.4 feet./sec.). The quality of the obtained emulsion is estimated by a specific surface of the dispersed (oil) phase which amounts to 1000 M2/M3.

Example 2

A hydrodynamic flow comprising 3 mass % alumina and 97 mass % water is delivered at a velocity of 55.7 meters/sec. (I 82.7 feet/sec.) through the inlet opening 2 in the device illustrated in FIGS. 3, 5. The flow of components passes through the contractor 4 in the flow channel 5 in which it streams over the conical portion of the bracket 42 and the baffle body 34 and passes through the gaps 45. At these sections of local contraction of the flow its velocity is maintained equal to 55.7 meters/sec. (182.7 feet/sec.). While streaming over the cones 35–41 and passing through the channel 5, the flow of components is subjected to a cavitation effect which ensures the intensive mixing and dispersion of the flow. The degree of cavitation of the cavitation fields formed downstream of the cones 35–41 is maintained at a level equal to 0.65, 0.62, 0.60, 0.57, 0.54, 0.51, 0.50, respectively. The velocity of the flow of the formed suspension amounts to 26.5 meters/sec. (86.9 feet/sec.). The ratio of velocities V@V amounts to 2. I. The quality of the obtained suspension is estimated by a mean diameter of the obtained particles which amounts to 3.8 p.m.

INDUSTRIAL APPLICABILITY

The invention will find application in the chemical and petrochemical industries in the production of paints, lacquers, insecticides, lubricating oils, chemicals, greases; in the fuel and electric-power industry for preparation of fuel on the basis of residual oils and furnace oils; in mechanical engineering—for preparation of emulsions and coolants; in perfumery industry—for production of liquid and cleaning agents, lotions and vitaminous preparations; in food industry—for production of tinctures, fruit juices, alcoholic and soft drinks, sauces and dairy products; for preparation of photo-emulsions and emulsions of different applications; for purifying water sewage by a reagents method.

We claim:

1. A method of obtaining a free disperse system comprising passing a hydrodynamic flow of components through a flow channel internally accommodating a baffle body providing a local contraction of the flow and generating downstream of this contraction a hydrodynamic cavitation field affecting the flow of components and resulting in the formation of a free disperse system, accomplishing the local contraction of the flow in at least two sections of the flow channel, and selecting the profile of cross-section of each of the sections and the distance there between them on condition that the ratio of velocity of said flow at each of these sections to the velocity of the free disperse system flow at the outlet from the flow channel, is maintained at a level equal to at least to 2.1 and the degree of cavitation of the hydrodynamic cavitation field is maintained at a level equal to at least 0.5.

2. A method according to claim 1, comprising forming the sections of the local contraction of the flow in succession one after another in the direction of the flow.

3. A method according to claim 1, characterized in that the sections of local contraction of the flow are formed in parallel to one another in one cross-section of the flow channel.

4. A method according to claim 3, characterized in that a gaseous component is introduced in the hydrodynamic flow of components at least at one section of the flow local contraction.

5. A method according to claim 3, characterized in that a gaseous component is introduced in the hydrodynamic flow of components at least downstream of one section of the flow local contraction.

6. A device for obtaining a free disperse system comprising a housing having an inlet opening and an outlet opening and internally accommodating a contractor, a flow channel provided with a baffle body and a diffuser installed in succession in said housing on the side of the inlet opening and connected with one another, said baffle body comprises at least two inter-connected elements with the shape and distance between them being determined on condition of each element forming downstream its own hydrodynamic field with a degree of cavitation equal to at least 0.5 and differing in the degree of cavitation from that of other hydrodynamic cavitation fields, and capable of interaction.

7. A device according to claim 6, wherein the elements of the baffle body are made from a flexible nonmetallic material.

8. A device according to claim 6, wherein the elements of the baffle body are provided with a coating made from a flexible nonmetallic material.

9. A device according to claim 6, characterized in that the bluff body (30) comprises at least three elements each of which is made in the form of the truncated cone (31, 32, 33) disposed so that axes thereof are in the plane of one cross-section of the flow channel (5) and are interconnected by the smaller bases with a bracket (42) arranged in the flow channel coaxially therewith and contacting by their larger bases the wall (11) of the flow channel (5), and the truncated cones (31–33) have different taper angles and the angles between their axes are selected on condition that areas of the gaps (43) between them are equal.

10. A device according to claim 9, characterized in that the truncated cones (31–33) are connected with the holder (42) for turning about the axes disposed in the plane perpendicular to the axis of the flow channel (5).

11. A device according to claim 9, characterized in that is comprises at least one additional bluff body (46) similar to the main body (30) and installed downstream of the latter in the direction of flow and connected therewith by a flexible element (47) for displacement along the axis of the flow channel (5).

12. A device for obtaining a free disperse system comprising a housing having an inlet opening and an outlet opening and internally accommodating a contractor, a flow channel provided with a baffle body, and a diffuser installed in succession in said housing on the side of the inlet opening and communicated with one another;

said baffle body comprises three inter-connected elements with the shape and distance between them being determined on condition of each element forming downstream its own hydrodynamic field with a degree of cavitation equal to at least 0.5 and differing in the degree of cavitation from that of other hydrodynamic cavitation fields, and capable of interaction; and said baffle body comprises three inter-connected elements being in the shape of hollow truncated cones arranged in succession in the direction of the flow and oriented by their smaller bases toward the contractor of which each preceding cone in the direction of the flow has the diameter of a larger base exceeding the diameter of a larger base of each subsequent cone, and the cones are secured respectively on rods installed coaxially in the flow channel and coaxially with one another, and adapted for axial displacement in relation to one another.

13. A device according to claim 12, wherein the distance between smaller bases of each preceding cone and each subsequent cone is selected to be equal to at least 0.3 of the diameter of the larger base of the preceding cone.

14. A device according to claim 12, wherein a taper angle of each subsequent cone is smaller than or is essentially equal to the taper angle of each preceding cone.

15. A device according to claim 12, wherein the elements of the baffle body are made from a flexible nonmetallic material.

16. A device according to claim 12, wherein the elements of the baffle body are provided with a coating made from a flexible nonmetallic material.

17. A device for obtaining a free disperse system comprising a housing having an inlet opening and an outlet opening and internally accommodating a contractor, a flow channel provided with a baffle body, and a diffuser installed in succession in said housing on the side of the inlet opening and connected with one another, said baffle body comprises at least two inter-connected hollow hemispherical elements with the shade and distance between them being determined on condition of each element forming downstream its own hydrodynamic field with a degree of cavitation equal to at least 0.5 and differing in the degree of cavitation from that of other hydrodynamic cavitation fields, and capable of interaction; and wherein the hollow hemispheres are arranged in succession in the direction of the flow and oriented by their vertices toward the contractor, and the first hemisphere in the direction of the flow has the diameter of the larger base exceeding the diameter of the larger base of the second hemisphere, and is secured on a hollow rod installed coaxially in the flow channel and the second hemisphere is secured on the rod installed in the space of the rod for displacement relative to the latter.

* * * * *